United States Patent [19]

Payne

[11] 3,931,716

[45] Jan. 13, 1976

[54] PILE SPLICE FOR CONCRETE AND STEEL PILES OF VARIOUS CONFIGURATION

[76] Inventor: Donald Payne, 53 O. K. Ave., Harahan, La. 70123

[22] Filed: June 7, 1974

[21] Appl. No.: 477,278

[52] U.S. Cl. ..... 61/53

[51] Int. Cl.[2] ..... E02D 5/34; E02D 5/22

[58] Field of Search ..... 61/53, 56, 53.5; 403/312, 403/310, 314, 335, 336, 338; 285/365, 407

[56] References Cited

UNITED STATES PATENTS

| | | | |
|---|---|---|---|
| 415,037 | 11/1889 | Gray | 61/53 |
| 669,673 | 3/1901 | Averbeck | 403/338 |
| 1,043,412 | 11/1912 | Faunce | 285/286 |
| 1,967,467 | 7/1934 | Damsel | 285/365 |
| 3,457,728 | 7/1969 | Pogonowski | 61/53 |
| 3,720,068 | 3/1973 | De Rosa | 61/53 |
| 3,744,577 | 7/1973 | Williams | 403/338 |
| 3,796,057 | 3/1974 | Dougherty | 61/53 |

FOREIGN PATENTS OR APPLICATIONS

| | | | |
|---|---|---|---|
| 589,324 | 3/1959 | Italy | 403/312 |

*Primary Examiner*—Paul R. Gilliam
*Assistant Examiner*—V. N. Sakran
*Attorney, Agent, or Firm*—Gardiner, Sixbey, Bradford & Carlson

[57] ABSTRACT

A pile splice is disclosed which completely satisfies the need for such a device which will enable structural analysis of the loads and stresses induced therein, which is simple and economical; which may be readily completed in the field with a minimum of construction equipment and comprises a pair of mating plates having machined abutting surfaces, one each carried by the pile section and embodying an outwardly projecting flange circumscribing the joint area. A tension band is applied to the flanges being comprised of two halves which are joined together at diametrically opposed points by upper and lower fillet welds so that the only stress in the bands is hoop stress induced by tension or bending and shear and the mating plates act in compression as a solid joint whereby all of the loads and resulting stresses in the joint section may be calculated by accepted stress-strain calculations.

19 Claims, 12 Drawing Figures

Figure 4:
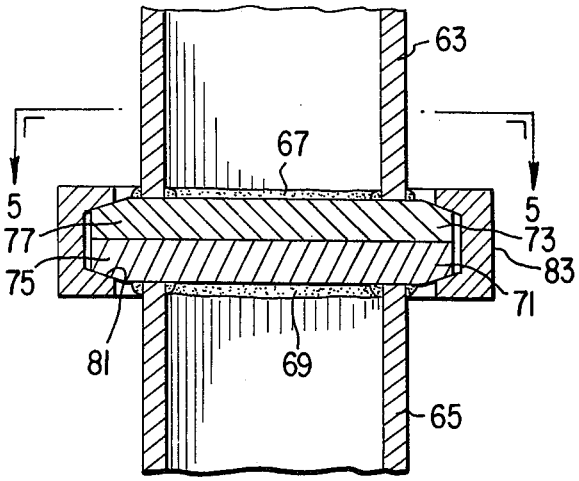

FIG. 1
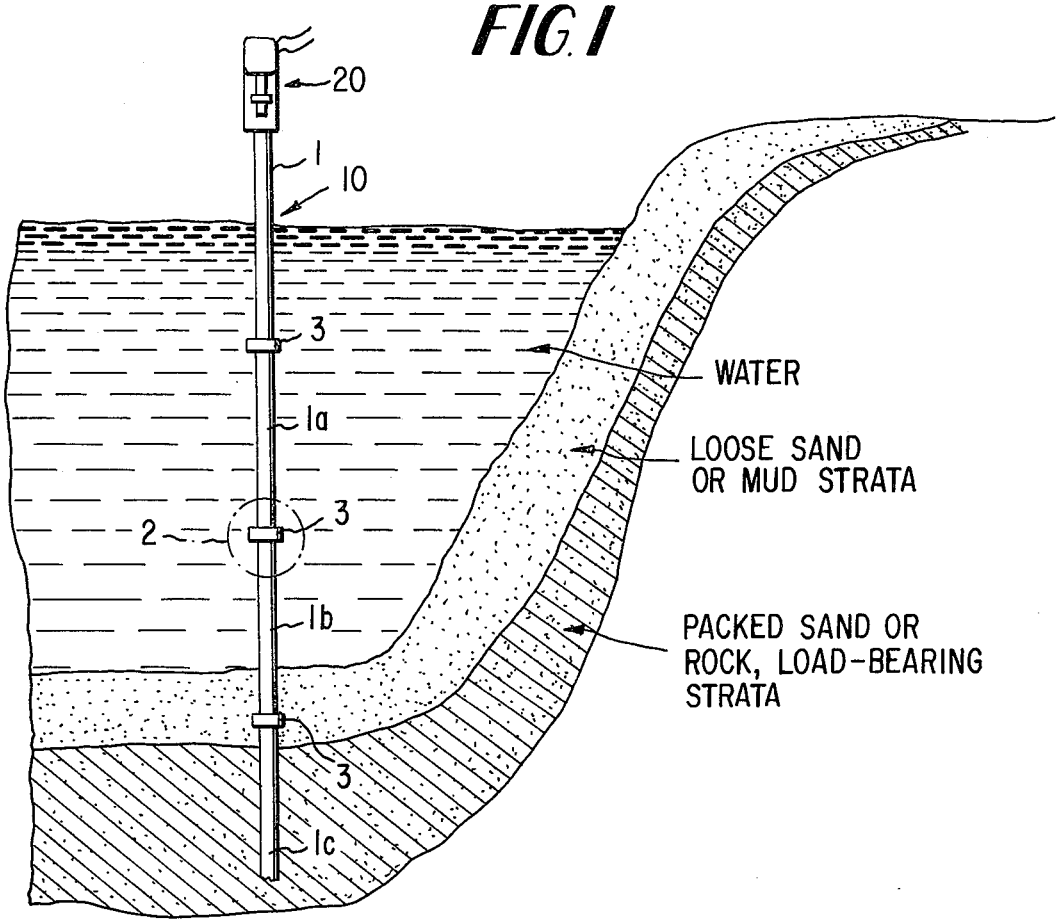
FIG. 3
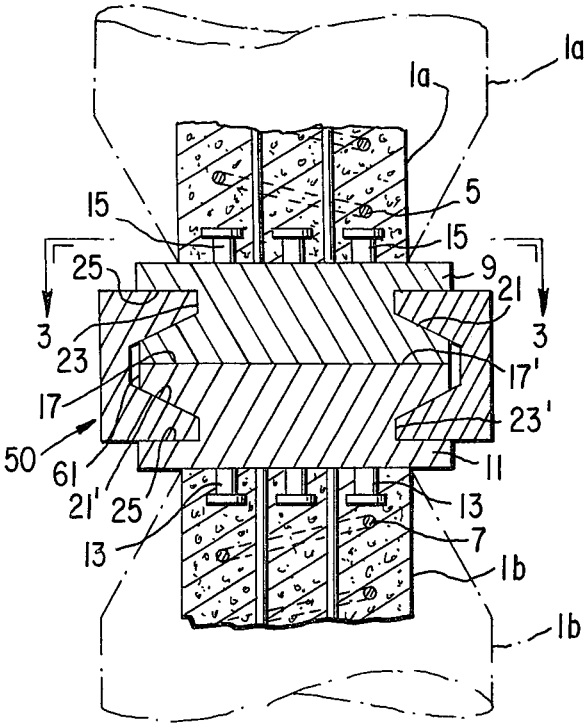
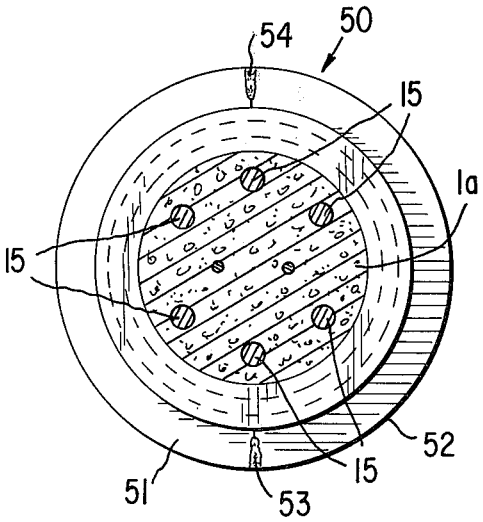
FIG. 2

PILE SPLICE FOR CONCRETE AND STEEL PILES OF VARIOUS CONFIGURATION

BACKGROUND

It is an accepted axiom, today, that land is becoming scarce. As the population increases more and more land is being used for habitable structures. The situation has become quite real and critical particularly in coastal areas or low lying areas adjacent rivers and lakes where the characteristics of the soil are such that it is not capable of supporting substantial structural loads such as are imposed by high rise office buildings, apartments, theaters, auditoriums and the like. Typical examples of areas where the noted soil condition exists would be the areas of New Orleans, Louisiana, Washington, D.C. and parts of the New Jersey coast where much of the land area is low lying swamp totally incapable of supporting structural loads and where even artificial fill does not materially improve the situation since the size and weight of structures built on so-called "fill land" are inherently limited by the nature of the area when filled.

Recently, too, a number of projects have been proposed wherein sizeable structures will be built in coastal waters adjacent land areas. One such proposal involves construction of a nuclear power plant off the New Jersey coast. Other proposals involve so-called "offshore" drilling for oil and the even more recently innovated unloading docks for recently developed "super tankers" which are so huge as not to be able to enter coastal parts and therefore must be unloaded "at sea" at offshore docking and pumping stations.

In effecting construction of structures on non-land or in areas of unstable land, the construction industry has resorted to the practice of placing such structures on a multiplicity of supports known as piles. These piles are driven into the ground by the use of mechanical means such as pile drivers, jet pumps, etc., to a sufficient depth that the lower end portion of the pile is embedded in substrata capable of supporting load both compressive and lateral bending loads transferred through the pile from the supported structure. One method of determining the capability of a pile to support loads is to measure the amount of penetrating movement axially of the pile each time the pile is struck at its top end by some type of impact device of known characteristics. When the rate of axial movement decreases to zero or to a predetermined rate per impact, its load carrying capacity can be determined by known engineering calculations. Obviously, it can readily be deduced that the number of piles to be driven to support a given structure becomes the sum total of the structural load as related to the ability of individual piles to carry load times the number of piles driven.

The pile support system is readily adaptable to support many and varied types of structures from apartments and office buildings to offshore drilling rigs and docking facilities and is widely used both here and abroad. However, as might be expected, there are problems connected with the techniques, one of the most pressing ones being the matter of pile length, as it is necessary to go further and further down into appropriate load supporting substrata. The answer to this would appear to be relatively simple—use longer piles. Unfortunately, however, there are practical limitations on pile length imposed by transport problems, limitations on driving equipment, handling equipment, etc., all of which more or less fix the maximum length of any given pile.

The alternative route to increasing pile length to unmanageable proportions, is to adapt a range of pile lengths which can be readily handled and to subsequently join the individual lengths by some type of on-the-site effected connection means. This alternative has been explored in a number of ways.

THE PRIOR ART

Possibly one of the most widely accepted alternatives for making long piles from individual pile sections by connection of the sections on site can be found in the "Brunspile" which is covered in U.S. Pat. No. 2,938,104. In this system, each individual pile section is fabricated of a cementitious material such as concrete in which are embedded spirally configured metal reinforcing rods and prestress tendons. The rods are given two spiral pitches, one throughout the length of the pile and a second more tightly coiled spiral adjacent each end of the cementitious body. The ends of the cementitious body, adjacent the tight spirals, are reduced to receive generally cylindrical ferrules thereover, which ferrules are subsequently inserted into a pile connector.

The pile connector is comprised of a cylindrical sleeve having a membrane area which bisects the sleeve through a plane lying approximately mid-way between the sleeve ends and normal to the sleeve axis. The membrane acts as an impact plate to transfer the impact shocks from the terminal end of one pile section through the ferrule to the membrane and thence through the ferrule on the end of the mating pile end through the body of the pile.

In order to lock the ferrules within the connector sleeve, the cylindrical wall of the connector is dimensioned so that the ferrules must be forced into the connector by axial impact applied to the pile section being connected.

Other types of pile connectors have also been devised though the so-called Brunspile has met with considerable commercial success. Such other proposals are best illustrated in U.S. Pat. Nos. 3,585,803 and 3,748,863, and 2,211,375, all of which involve the use of rather complicated structures. Another approach, particularly for steel piling, has been to simply weld the ends of the pile sections as driving proceeds. However, this method has a great number of disadvantages in that welding time runs for hours and during this period a lot of expensive equipment and labor is idled. Too, where the pile driving operation is being conducted "offshore" the difficulties of using this technique are almost insurmountable.

Thus, the Brunspile system of all the known pile connector systems, has found considerable acceptance in the construction field, but only so long as the prevailing conditions of use are such that the loads imposed on the driven piles are primarily and essentially only a compression load axially of the assembled piling.

As the use of areas of less and less stable substrata or in conditions such as encountered in construction of "offshore" rigs has progressed, the Brunspile system has become unable to fulfill the need because it has been discovered that under such conditions the piling is not always subject to simple compression loads but may be subject to severe bending loads and known tension loads which would cause failure of the Brunspile connector system with attendant disasterous results. To further complicate the situation, the Brunspile system does not permit of calculation of its stress limits under any load, other than compression loads, by known mathematical and structural analysis. Thus, if it is suspected that bending or tension loads might come into play in a particular situation, the use of the Brunspile system is immediately suspect and in fact, may be automatically rejected as unpatentable because there is just no way to predict with any degree of certainty what-soever, that a structural failure cannot occur. Thus, the industry is forced to resort to other time-consuming, expensive and inconvenient connector systems.

THE INVENTION

With the foregoing background in mind, it becomes readily apparent that the construction industry desperately needs a pile connector system that is:

1. usable in on-site situations,
2. economical,
3. lends itself to stress calculations by known classical stress and strain analysis and calculation,
4. readily effected by conventional equipment,
5. uncomplicated,
6. acceptable in every conceivable situation,
7. capable of resisting bending loads, and, finally,
8. capable of absorbing unexpected or known tension loads.

The present invention, then, has for its objectives the fulfillment of all of the above stated needs and also various other objectives which while not specifically set forth, are readily apparent to those skilled in the construction and engineering arts, in particular, the art of pile construction and driving methods.

In general, the connectors comprising the invention include a pair of impact plates, one each of which is attached by appropriate means to the ends of two pile sections to be joined, said plates having an area larger than the ends of the pile sections to define an annular flange between the sections, said flange having preferably slightly sloping surfaces facing toward each pile section and ring or band means having an internal annular recess surrounding said plates and in engagement only with the flange faces facing each pile section, said ring or band being diametrically expandable to enable its placement over the flanges when said impact plates are in face-to-face abutment and means for fastening said band around said plates. The plates may also include means for centering the adjacent pile sections in axial alignment during joinder of two abutting sections.

Figure 5:
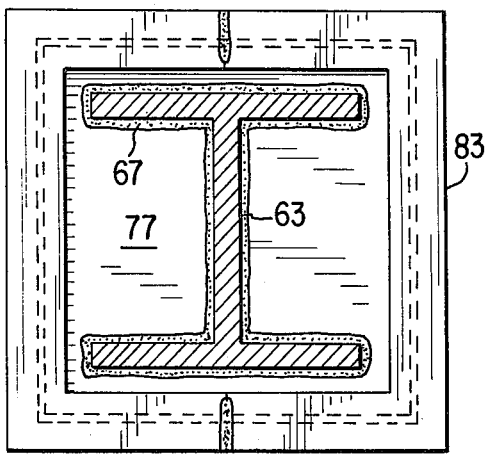
Figure 8:
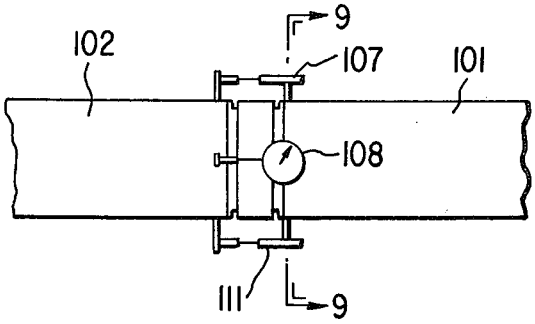
Figure 6:
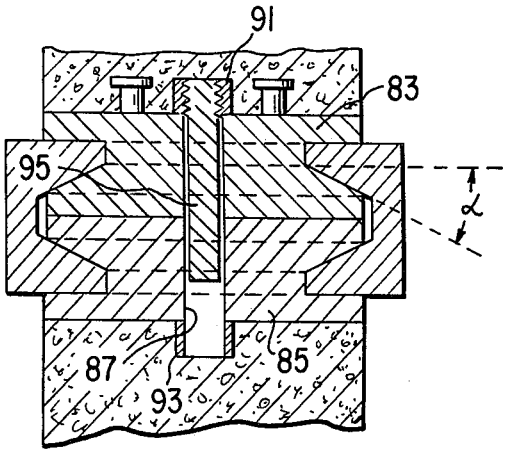
Figure 9:
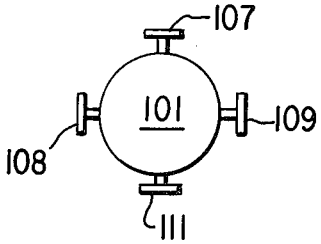
Figure 7:
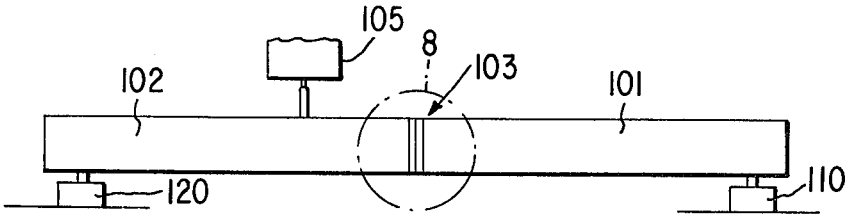
Figure 10:
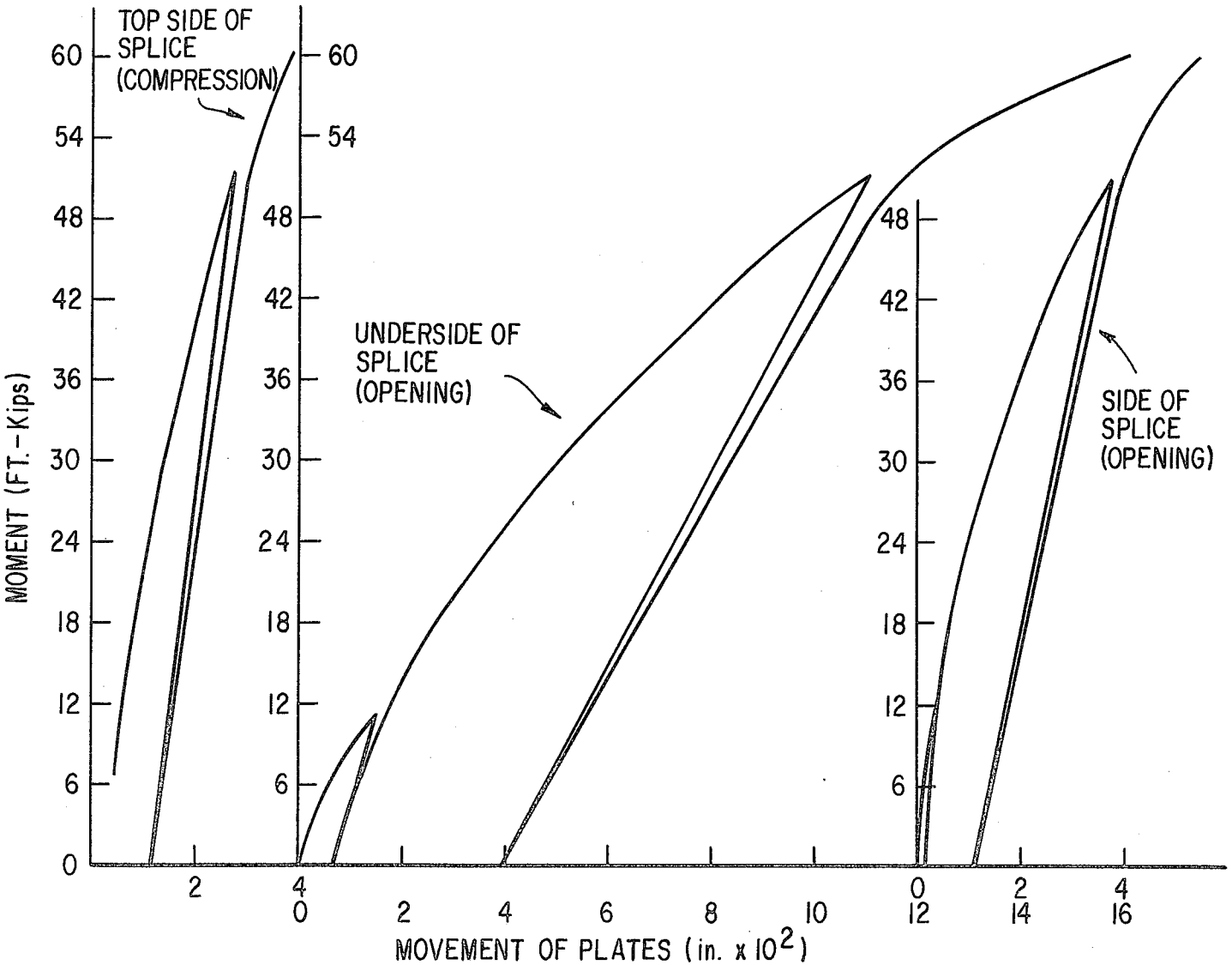
Figure 11:
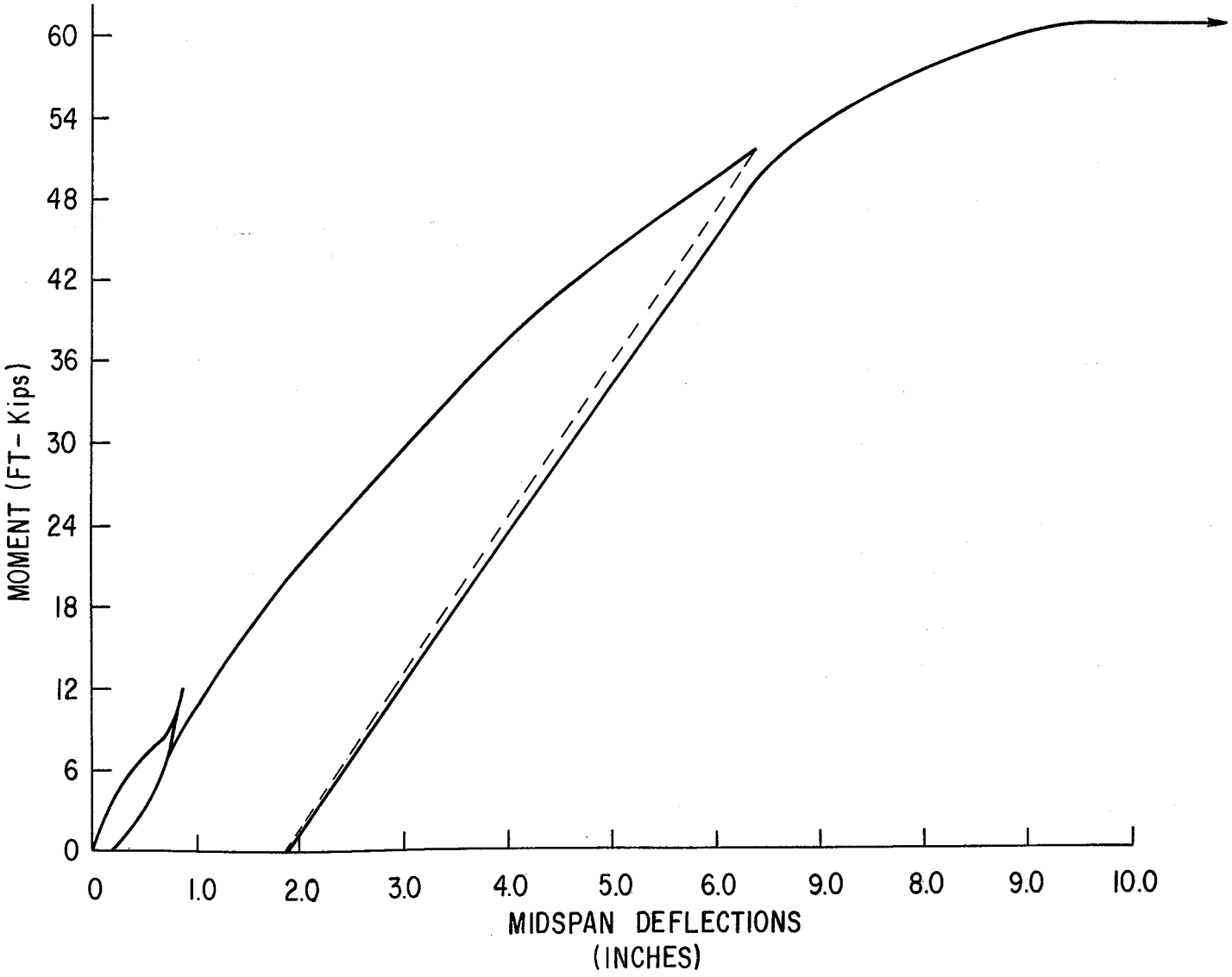
Figure 12:
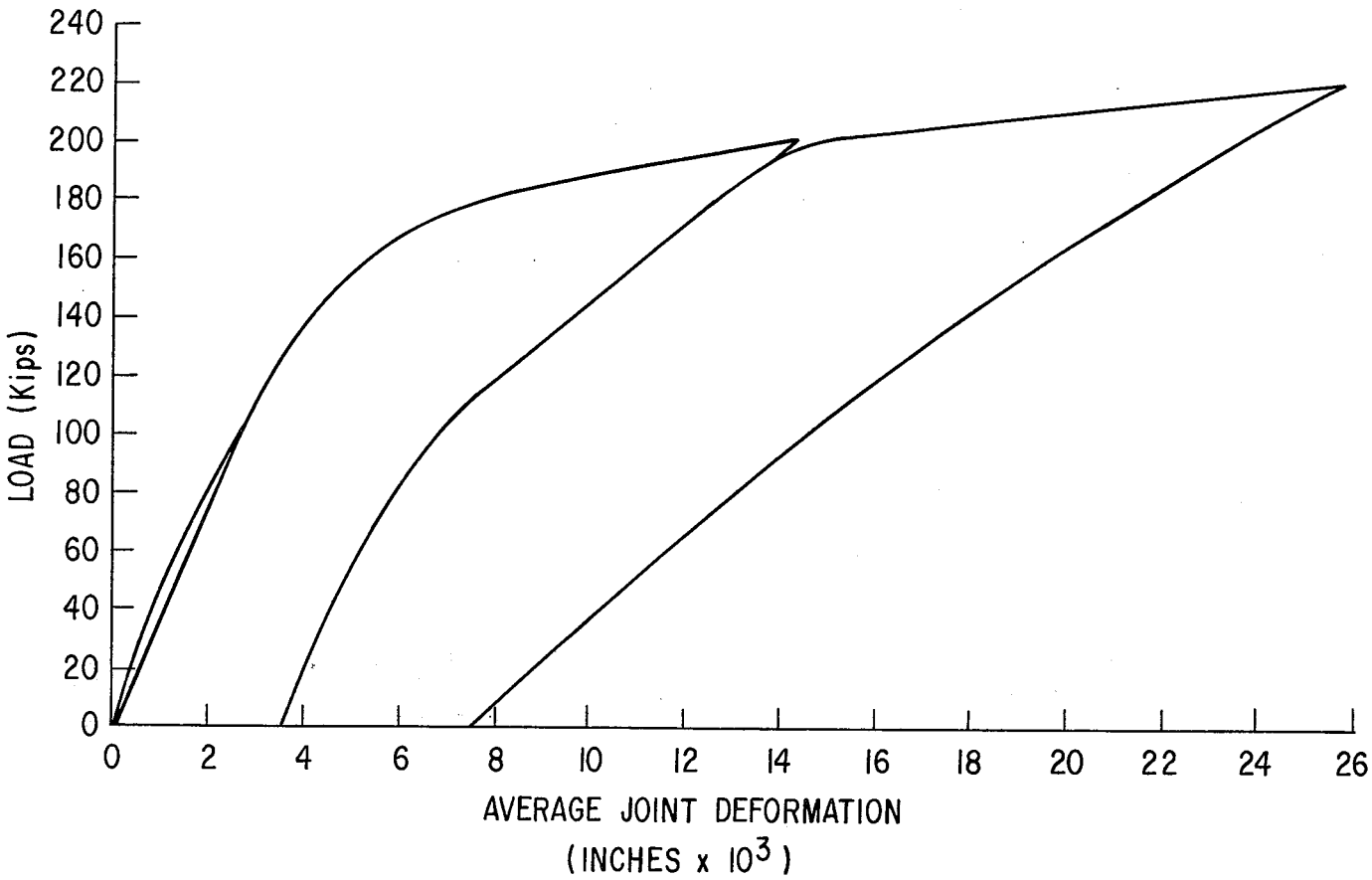

Having set forth in general terms the essentials of the inventive concept, consideration thereof in detail may be obtained from the following detailed description wherein reference is made to the drawings forming a part of such descriptive material, and wherein FIG. 1 is a schematic view, partially in section showing the invention as used in an "offshore" application, FIG. 2 is an enlarged view of a pile connector noted in FIG. 1 and is a typical view, FIG. 3 is a sectional view taken along the line 3—3 of FIG. 2, FIG. 4 is a sectional view taken along the axis of an "H" steel piling, showing a modified form of the invention, FIG. 5 is a sectional view taken along the line 5—5 of FIG. 4, FIG. 6 is a sectional view of a pile connector similar to that disclosed in FIG. 2 but showing a means to facilitate alignment of abutting pile sections during erection, FIG. 7 is a schematic view showing a test set up for data reproduced in FIGS. 10 and 11, FIG. 8 is an enlarged view of the area bounded by the dotted line circle of FIG. 7, FIG. 9 is a sectional view taken along the line 9—9 of FIG. 8, FIG. 10 is a graph of the test data procured from the test configuration of FIG. 7, FIG. 11 is a graph of additional data obtained from the FIG. 7 test configuration, and, finally, FIG. 12 is a graph of tensile test data.

Directing attention to FIG. 1, there is illustrated a typical deep pile situation wherein the structure to be supported is over water. As shown the substrata consists of a layer of loose sand or mud which progressively deepens as the water depth increases. Regardless of the composition, the particular strata is incapable of providing a solid base in which to anchor the pile 10.

Beneath the first-mentioned strata is a further substrata such as hard sand, mixed rock and sand which is capable of performing as a proper pile anchor when the pile is driven deep enough thereinto. It is assumed, for example, that from the water surface to the supporting substrata is a vertical distance of 150 feet and that the pile 10 must be driven at least another 150 feet into the anchoring strata to provide for its designed load bearing capacity. Thus, the pile 10 would be of a length of 300 feet, if an integrated structure, and would be impossible to transport or handle with conventional equipment such as barge cranes, floating pile drives, graphically illustrated as 20.

Accordingly, lacking all factors into consideration the pile is made up of pile sections 1, 1*a*, 1*b*, 1*c*, each of which is 75 feet in length and therefore must be joined by pile connectors 3 to form a piling of adequate length.

In the example, each pile section is fabricated of concrete suitably reinforced by a spiral steel reinforcement such as reinforcement rods 5 and 7 and tendons, shown in FIG. 2. Following customary practice, the number of turns of the reinforcing rods 5 and 7 may be variable depending on anticipated design loads. Similarly, the pile diameter is a function of anticipated load.

Due to the particular situation, i.e., the proximity of the shore or because the structure may rest on piling which may be on the shore, it must be anticipated that any given pile may be subject to other than simply axial compression loads. For example, due to tidal or wave conditions or shifting of the shore, the pile 10 might be subject to bending or even tension loads since there is no guarantee that other piling supporting the structure will be subjected to identical conditions or will even react in the same way as any other pile under such conditions.

Since the prior art connectors, noted heretofore, are either difficult to work with or will not take to bending or tension loads or their reaction to such loading is uncalculable or unpredictable, the structural engineer or foundation designer is placed on the horns of a dilemma—expensive piling or gamble with less expensive but potentially disasterous connectors.

As illustrated, however, the connectors 3 of the structure of this present invention are illustrated in detail in FIGS. 2 and 3, as applied to concrete pile sections, 1*a*, 1*b*, etc.

The pile sections, for example, 1*a* and 1*b* are prefabricated at the manufacturing source, wherever it may be, and in the process each end is provided with a generally circular impact plate. In FIGS. 2 and 3, the impact plates are designated by reference numerals 9 and 11. The plates 9 and 11 are affixed to the concrete matrix of each section by means of embedded studs 13, 15 having known characteristics, a prime example being identified as "Nelson" studs which may be readily purchased on the open market.

Each impact plate is carefully aligned during its joinder to the particular pile section so that its abutment face 17, 17′ as shown in FIG. 2 is as perfectly normal to the axis of the pile section 1*a*, 1*b* as is possible to attain during the fabrication process.

After the concrete matrix of each pile section 1*a*, 1*b* etc. is cured, i.e., set and hardened, the accuracy of the abutment face and pile axis relationship is carefully checked. If the abutment face is perfectly normal to the axis of the given pile section, the individual section is ready for use. However, should accuracy be lacking, the abutment faces 17, 17′ may be finished, by known machining techniques to secure the desired accuracy, after which the sections are ready for use.

In addition to the abutment faces 17, 17′, each impact plate 9 and 11 is provided with a peripheral slot or groove of a modified "V" configuration in that one surface of the slot is an annular conical land 21, 21′, another, a cylindrical peripheral wall 23, 23′ and, finally a second annular land 25, 25′ which lies in a plane bisecting the pile axis normal thereto. As shown in FIG. 2, the conical land 21 of the groove always faces toward the body of the pile matrix while the annular land of the groove faces toward the end of the pile matrix.

As shown in FIG. 2, each end of a given pile section 1*a*, 1*b* etc., is identical so that when the pile sections are assembled in end-to-end axial alignment the abutting impact plates form a symmetrical flange assembly wherein the two conical lands 21, 21′ define a generally triangular shaped clamping flange assembly 40 adapted to receive a circumscribing clamping collar 50.

The clamping collar 50 is comprised of two arcuate segments (see FIG. 3) 51 and 52, which are welded together at two diametrically opposed weld seams 53 and 54. The interior of the collar is also provided with a groove having a pair of divergent conical clamping lands 57, 59 and a cylindrical base surface 61 defining the bottom of the groove. Preferably, the diameter of the base surface 61 is slightly greater than the diameter of the outer surface of the abutment plates whereby when the collar halves 51 and 52 are placed in position around the abutment plates, the inner cylindrical wall of the collar is spaced from the cylidrical wall defined by the outer surfaces of these assembled plates. Thus, the prime contact area between the collar 50 and the abutment plates becomes the conical lands 21, 21′ of the abutment plates and the diverging conical lands 57, 59 of the clamping collar.

The collar halves, 51, 52 are drawn together by any suitable means such as a chain wrapped around the collar halves and placed under tension so that the ends of the two collar halves are drawn into closely adjacent, but not abutting relationship. Thereafter, a weld is effected between the two collar halves at 53, 54, care being taken not to weld the collar to the abutment plates 9 and 11.

As shown in FIG. 2, the connector assembly is somewhat larger in diameter than the joined piles 1*a*, 1*b*, etc. However, in many cases, this would be undesirable, hence, as illustrated in dotted line outline, the pile matrix may be so fabricated as to be of larger cross section than the connector assembly and with the respective ends "necked down" to the dimensions necessary to effect connection with the proper size connector to meet calculated loads.

With respect to the clamping collar 50, it is possible to fabricate same of one piece rather than of two semicircular segments if so desired. In that case, the collar would be formed with but one unconnected portion and installed by prying this portion open to enable it to be fitted around the abutment plates after which the noted clamping step is effected followed by welding of the adjacent ends of the collar which then has but a single weld bead as for example, bead 54, the bead 53 being eliminated.

In FIGS. 4 and 5, the invention is shown as applied to steel piling of the typical "I" or "H" beam cross-sectional configuration. Also are shown modified abutment plates used in this application.

As shown, the pile sections 63, 65 are welded at 67, 69 to abutment plates 71, 73. The plates 71 and 73 are rectangular in plan configuration, see FIG. 5, and are of such dimensions, length and widthwise, as to provide a peripheral flange 75, 77 completely around the marginal edges of the plates when welded in place on the ends of the pile sections 63, 65. The surfaces 79, 81 of the flange facing the pile sections is sloped outwardly and downwardly to receive a clamping collar 83 which is identical in cross-sectional configuration to the cylindrical collar 50 of FIG. 3, but which in plan view is rectangular to accommodate the rectangular configuration of the abutment plates as is readily apparent in FIG. 5. In all other respects, including welding of the collar, the installation is identical to those details set forth in connection with FIGS. 2 and 3.

A further modification of the connector is shown in FIG. 6. In this modification, the abutment plates 83, 85 are provided with central apertures 87, 89 respectively. When the pile sections are cast, an internally threaded ferrule 91, 93 is carefully aligned with the longitudinal axis of the pile section and becomes embedded in the matrix and is aligned with the apertures 87, 89 in each plate 83, 85.

When the pile sections are being assembled on the construction site, a threaded rod 95 may be engaged in either ferrule 91 or 93 to serve as an alignment pin when two adjacent pile sections are being aligned for connection. Since each end of the pile sections is identical, the rod 95 may be inserted in either end of a given section. Further, since the rods are inserted only when needed, there is little danger that misalignment of any two pile sections will occur since there is no likelihood that the pins will be bent during transport or handling of the sections as might be the case where the pins 95 were molded or embedded directly in the matrix of the sections.

Returning for a moment to a discussion of the abutment plates and in particular the sloping or conical land areas, it should be noted that the degree of slope or the angle of generation for the conical surface is not critical. The prime function of using sloping or conical surfaces is to assure proper contact of the clamping collar with the abutment plates and to avoid the manufacturing difficulties that would be involved in attempting to secure proper contact between two planar faces in abutment, since it is essential that the collar mate the abutment plates into complete face-to-face contact. It can be said, however, that a reasonable slope angle $\alpha$ would be in the neighborhood of 2° to 15° as measured along a given radius or longitudinal axis, note FIG. 6.

With the structure of the connector defined, consideration will now be given to one of the principal advantages of the invention over the prior art. It has been stated herein that one of the problems sought to be overcome is to provide a connector which follows known and calculable reaction to compression bending and tension loads. Thus, consideration of the conditions to which the connector may be subject reveals that all compression and impact loads are transmitted directly through the impact plates as pure compression and may be readily analyzed since these plates will transmit the load directly for section to section so that conventional column stress analysis and formula apply as the assembled piles act as a true integral column in compression.

Similarly, if either bending or tension loads are imposed on the assembled pile, these loads are transmitted to the abutment plates and from the abutment plates to the clamping collar which becomes stressed due to tensile forces which arise when the collar is forced to try to expand tremendously so that its inside diameter is equal to the outside diameter of the abutment plates. The collar then must elongate $\pi$ times 2 times the distance the collar is overlapped into the abutment plate groove. Thus, the collar is subject to hoop stress which is readily determinable and its loading may be established by known mathematical formulae and calculated readily to determine the material requirements that the collar must embrace to resist such stresses.

Another advantage of the present invention resides in the fact that since the abutment plates are not welded together there is no danger of weld fracture as might occur, for example, in the lower connectors of known prior art systems, particularly welded joints which tend to work harden under impact, due to repeated impact loads that are imposed during the pile driving operation.

As might be said in the case of any structural innovation, proof lies in performance which should substantiate the design calculations originally made in fabrication. To this end, the following test example, substantiates all that has been said before.

FIG. 7 is a schematic illustration of the test installation. The pile sections were two 14 inch square concrete pile sections, each 10 feet in length. The concrete matrix had a nominal compressive strength of 5,000 psi. The connector was formed in accordance with FIG. 2 and the description thereof.

The joined sections 101, 102 with the completed connector 103 were then placed on two pedestals 110 and 120 in a true horizontal position. The unsupported span length between pedestals was 18 feet clear.

Load was applied by hydraulic jack 105 at a location 6 feet from one end reaction point to place the connection under moment and shear load.

Deflection measurements were taken at the joint 103 and at the load point.

As shown in FIGS. 8 and 9, measuring gauges 107, 108, 109 and 111 were mounted at positions 90° apart at the connector 103 to measure rotation.

To further substantiate the foregoing statements, a test specimen was evaluated in tension by welding abutment plates to steel pipe sections and completing the connector as described in connection with FIG. 2. Pipe sections were used so as to obtain a true evaluation of the connector assembly, per se, without any variables as might be induced by the matrix bond to the embedded studs 15 of FIG. 2.

FIG. 12 is a graph of the results from which it can be concluded that the test specimen performed as anticipated.

Throughout the foregoing discussion the collar has been defined as welded in place surrounding the abutment plates. It should be understood that the collars may be bolted in place having been provided with apertured ears and the abutting ends of the collar which method is less preferred and not illustrated in detail being readily apparent to those skilled in the art. However, since bolting complicates the stress analysis picture by introducing additional factors and calculations on the scene, the preferred method is to weld the collar as illustrated throughout the specification.

Having described the invention in its best mode and modifications thereof, it will be appreciated that various modifications as may occur to those skilled in the art are embraced within the inventive concept defined by the appended claims.

What is claimed is:

1. The method of forming a plurality of pile sections into an integrated piling assembly comprising the steps of casting an elongated pile section matrix having abutment plates of identical configuration and outwardly extending, sloping flange areas integrated in the matrix; manipulating said plates to dispose the outer surfaces thereof in a plane precisely normal to the longitudinal axis of the pile section; thereafter while on site, placing at least a pair of pile sections in end-to-end aligment with the abutment plates at one end of a pile section in abutment throughout its entire end face area with the abutment plate of the other of said pile sections; surrounding the outwardly extending, sloping flange areas of said abutment plates with a clamping collar having at least one discontinuous portion; closing said collar against the edges of said abutment plates by compression to reduce the span of the discontinuous portion by drawing the collar ends into closely adjacent but non-abutting relation and thereafter welding only said collar to close said discontinuous portion, without welding said abutment plates to each other or to said collar.

2. The method as defined in claim 1 wherein the pile sections are cast at a point of manufacture and are placed and joined together in end-to-end abutment on the job site.

3. The method as defined in claim 1, wherein after a pair of pile sections are joined said assembled sections are subjected to a pile driving step and after which step the assembly of two pile sections is repeated to produce an integrated pile assembly of the required length.

4. A connector for concrete pile sections comprising a pair of impact plates, one each of which is attached by incorporation into the body of each pile means to the ends of two pile sections to be joined; said plates having an area larger than the cross-sectional areas of the ends of the pile sections to provide an annular flange extending outwardly of the pile sections at the ends of the sections, each flange including a slightly outwardly and downwardly sloping surface facing toward each pile section; a clamping collar completely circumscribing the plates and having an annular recess comprised of a cylindrical wall and a pair of annular land faces opening inwardly thereof toward said plates, said band surrounding said plates and being in engagement only with the sloping surfaces of the flanges on said abutment plates, said clamping collar being diametrically expandable to enable its placement over the flanges when said impact plates are in face-to-face abutment; and means for fastening said collar in compression around said plates whereby only a hoop stress is developed in said collar.

5. A pile connector as defined in claim 4 wherein said clamping collar is comprised of two semi-circular sections and said fastening means is comprised of diametrically opposed weld beads joining only said sections together.

6. A pile connector as defined in claim 4 wherein said collar is discontinuous at one area and wherein the discontinuous area is filled by a weld bead after said collar is placed around said outwardly extending flange areas of said impact plates.

7. A pile connector as defined in claim 4 wherein said impact plates are circular and said sloping flange surface is frusto-conical, and said land faces define frusto-conical mating surfaces diverging toward the inward facing opening of the recess.

8. A pile connector as defined in claim 4 wherein said impact plates are polygonal and said clamping collar embraces each of the polygonal sides.

9. A pile connector as defined in claim 4 wherein means are provided at the pile ends to effect longitudinal alignment of two abutting pile sections.

10. A pile comprised of a plurality of pile sections assembled into end-to-end alignment, a plurality of identical connector means joining the pile ends, each connector comprising abutment plates of identical configuration attached to each end of the pile sections; said plates being disposed on the pile ends in planes precisely normal to the longitudinal axis of each such pile section, the abutment plate at one end of an individual pile section being in contact throughout its entire end face area with the abutment plate of the next adjacent one of said pile sections; a clamping collar having at least one discontinuous portion in engagement with the edges of said contacting abutment plates under compression to reduce the span of the discontinuous portion and fastening means for holding said collar closed and in compression without attaching said abutment plates to each other or said collar to either of said abutment plates.

11. A pile as defined in claim 10 wherein each pile section is comprised of a cast concrete matrix.

12. A pile as defined in claim 10 wherein each pile section is comprised of a steel structural section.

13. A pile as defined in claim 10 wherein said abutment plates and said collar are fabricated of mild steel.

14. A pile as defined in claim 10 wherein said clamping collar is comprised of two semi-circular sections and said fastening means is comprised of diametrically opposed weld beads joining said sections together.

15. A pile as defined in claim 10 wherein said collar is discontinuous at one area and wherein the discontinuous area is filled by a weld bead after said collar is placed around said flange.

16. A pile as defined in claim 10 wherein said abutment plates are circular and said sloping flange surface is frusto-conical and said land faces define frusto-conical mating surfaces diverging toward the inward facing opening of the recess.

17. A pile as defined in claim 10 wherein said sloping flange surface defines one surface of an outwardly opening circumferential groove formed around the edge of said circular abutment plates.

18. A pile as defined in claim 10 wherein said abutment plates are polygonal and said clamping collar embraces an equal number of polygonal sides.

19. A pile as defined in claim 10 wherein means are provided at the pile ends to effect longitudinal alignment of two abutting pile sections.

* * * * *